US006589091B2

(12) United States Patent
Harada

(10) Patent No.: US 6,589,091 B2
(45) Date of Patent: Jul. 8, 2003

(54) FABRICATION MACHINE FOR FABRICATING SPARK PLUG WITH PLURALITY OF GROUND ELECTRODES AND FABRICATION METHOD USING SAME

(75) Inventor: Akira Harada, Mie-ken (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/047,114

(22) Filed: Jan. 17, 2002

(65) Prior Publication Data

US 2002/0094743 A1 Jul. 18, 2002

(30) Foreign Application Priority Data

Jan. 18, 2001 (JP) ..... 2001-010681

(51) Int. Cl.[7] ..... H01T 21/02
(52) U.S. Cl. ..... 445/7
(58) Field of Search ..... 445/7

(56) References Cited

U.S. PATENT DOCUMENTS 4,643,688 A * 2/1987 Byerly et al.
5,022,881 A * 6/1991 Nagy
5,159,233 A * 10/1992 Sponseller et al.

FOREIGN PATENT DOCUMENTS

JP 11-154582 6/1999
JP 2000-164320 6/2000
JP 2000-164321 6/2000

* cited by examiner

*Primary Examiner*—Gary Paumen
(74) *Attorney, Agent, or Firm*—Nixon & Vanderhye P.C.

(57) ABSTRACT

A spark plug fabricating machine and a method using the same are provided. The fabricating machine is designed to bend a plurality of electrode bars to fabricate L-shaped ground electrodes which have ends facing a center electrode through spark gaps, respectively. The fabricating machine includes a press mechanism and a holder supporting mechanism. The press mechanism works to press the electrode bars welded to a housing retained by a housing holder against a first die. The first die is held between the electrode bars and has curves each contoured to conform with an L-shape of the ground electrodes. Specifically, the press mechanism moves a second die to press each of the electrode bars against a corresponding one of the curves of the first die. The holder supporting mechanism supports the housing holder so as to allow each of the electrode bars to swing in substantially the same direction as movement of the second die for absorbing a clearance between each of the electrode bars and the first die to establish a direct contact between the electrode bar and the curve of the first die when the electrode bar is bent by the second die, thereby resulting in uniformity of bend angles of the ground electrodes.

7 Claims, 7 Drawing Sheets

FABRICATION MACHINE FOR FABRICATING SPARK PLUG WITH PLURALITY OF GROUND ELECTRODES AND FABRICATION METHOD USING SAME

BACKGROUND OF THE INVENTION

1 Technical Field of the Invention

The present invention relates generally to a fabrication machine for a spark plug which may be employed in automotive engines and a spark plug fabrication method using the same, and more particularly to such a spark plug fabrication machine capable of bending a plurality of ground electrodes of a spark plug to an L-shape uniformly and a spark plug fabrication method using the same.

2 Background Art

FIG. 1 shows a typical two-ground electrode spark plug 1 which consists of a metal housing or shell 4 on which ground electrodes 3 and a central electrode 2 are installed, a porcelain insulator 5, a metal stem 7 with a terminal 6, and a resistor 8 having a given electric resistance. Electric sparks are produced between the ground electrodes 3 and the central electrode 2 to ignite a gaseous fuel.

The fabrication of each of the ground electrodes 3 is achieved by welding a bar electrode to an end of the metal shell 4 and bending it to an L-shape. This type of spark plug, however, has a difficulty in bending two ground electrodes to a uniform shape for reasons as discussed below.

FIG. 7 demonstrates a typical method of bending straight bar electrodes 3*a* after welded on the metal shell 4 to fabricate the ground electrodes 3. First, a die 13 having curves contoured to conform with the L-shape to which the bar electrodes 3*a* are to be finished is interposed between the bar electrodes 3*a*. Press bars 14 are moved from the outsides of the die 13 in approach directions to push the bar electrodes 3*a* against the curves of the die 3, thereby bending the bar electrodes 3*a* to the L-shape. The metal shell 4 and the die 13 are held firmly by, for example, a die chuck.

The die 13 is usually easy to form to have the curves conforming in contour with a desired L-shape of the ground electrodes 3. It is, however, difficult to weld the bar electrodes 3*a* to the metal shell 4 at desired locations accurately. This may result in variations in distances d1 and d2, as shown in FIG. 8(*a*), between the bar electrodes 3*a* and the center of the metal shell 4 which are usually greater than a dimensional error of the die 13. Specifically, different gaps $\delta 1$ and $\delta 2$, as shown in FIG. 8(*b*), are created between inner walls of the bar electrodes 3*a* and side walls of the die 13, thereby, as shown in FIG. 8(*c*), resulting in differences in radius of curvature between the die 13 and the bar electrodes 3*a* after bent, which leads to a difference in contour between the ground electrodes 3. This will cause a undesirable difference in springback between the ground electrodes 3 to be produced, so that the distance between one of the ground electrodes 3 and the center electrode 2 will differ from that between the other ground electrode 3 and the center electrode 2, thereby resulting in instability of sparks.

SUMMARY OF THE INVENTION

It is therefore a principal object of the invention to avoid the disadvantages of the prior art.

It is another object of the invention to provide a spark plug fabricating machine capable of bending ground electrodes to be uniform in shape and a spark plug fabricating method using the same.

According to one aspect of the invention, there is provided a fabricating method capable of bending ground electrodes of a spark plug to a substantially L-shape uniformly. The ground electrodes have ends facing through spark gaps a center electrode installed in a housing. The spark plug fabricating method comprises the steps of: (a) welding at least two electrode bars to the housing of the spark plug at a given interval away from each other; (b) placing a first die at a location where the center electrode is to be installed between the electrode bars, the die having curves each contoured to conform with the L-shape of the ground electrodes; (c) moving a second die to urge one of the electrode bars into contact of an inner surface thereof with the first die; (d) pushing the second die to press the one of the electrode bars against a corresponding one of the curves of the first die, thereby bending the one of the electrode bars to fabricate one of the ground electrodes of the L-shape; (e) moving a third die to urge the other electrode bar into contact of an inner surface thereof with the first die; and (f) pushing the third die to press the other electrode bar against the other curve of the first die, thereby bending the other electrode bar to fabricate the other ground electrode of the L-shape.

In the preferred mode of the invention, the fabricating method further comprises the step of holding the housing so as to allow each of the electrode bars welded on the housing to move relative to a corresponding one of the second and third dies for absorbing a gap between each of the electrode bar and the first die. The holding step also places the housing so that each of the electrode bars is located at a given interval away from one of deformation avoiding blocks installed outside the electrode bars.

The interval is between 0.2 mm and 0.25 mm.

Each of the second and third dies is implemented by a rotary roller having a peripheral surface which urges a corresponding one of the electrode bars into engagement with the first die.

Each of the rotary rollers has formed in the peripheral surface thereof a groove in which a corresponding one of the electrode bars is engaged when bent.

The fabricating method may further comprise the step of, after each of the electrode bars is bent, adjusting the spark gap between the electrode bar and the center electrode.

Each of the pushing steps may bend one of the electrode bars to an angle greater than a bend angle of the ground electrodes for compensating for springback.

According to the second aspect of the invention, there is provided a spark plug fabricating machine designed to fabricate at least two L-shaped ground electrodes to have ends facing through spark gaps a center electrode extending along a longitudinal center line of a spark plug. The spark plug fabricating machine comprises: (a) a housing holder holding a housing of the spark plug to which at least two electrode bars are joined at a given interval away from each other; (b) a first die held between the electrode bars, the first die having curves each contoured to conform with an L-shape of the ground electrodes; (c) a press mechanism moving a second die to press each of the electrode bars against a corresponding one of the curves of the first die, thereby bending the electrode bar to a desired angle for fabricating each of the L-shaped ground electrodes; and (d) a holder supporting mechanism supporting the housing holder so as to allow each of the electrode bars joined to the housing to swing in substantially the same direction as movement of the second die by the press mechanism for absorbing a clearance between each of the electrode bars and the first die to establish a direct contact between the electrode bar and the curve of the first die when the electrode bar is bent by the second die.

In the preferred mode of the invention, die blocks are further provided which have faces opposed to the electrode bars through a given gap, respectively, for avoiding unwanted bulging of the electrode bars toward the second die when pressed by the second die.

The gap is preferably between 0.2 mm and 0.25 mm.

The second die includes rotary rollers each having a peripheral surface which urges a corresponding one of the electrode bars into engagement with the first die.

Each of the rotary rollers has formed in the peripheral surface thereof a groove in which a corresponding one of the electrode bars is engaged when bent.

A hammer may be provided which works to strike tips of the electrode bars after bent by the second die for adjusting a gap between each of the ground electrodes and the center electrode.

The press mechanism may bend each of the electrode bars to an angle greater than a bend angle of the ground electrodes for compensating for springback.

BRIEF DESCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings:

FIG. 8(*b*) is a side view of FIG. 8(*a*); and

FIG. 8(*c*) is a side view which shows a undesirable variation in bend angle of ground electrodes fabricated in a conventional manner.

DESCRIPTION OF THE PREFERRED EMBODIMENTS

Figure 1:
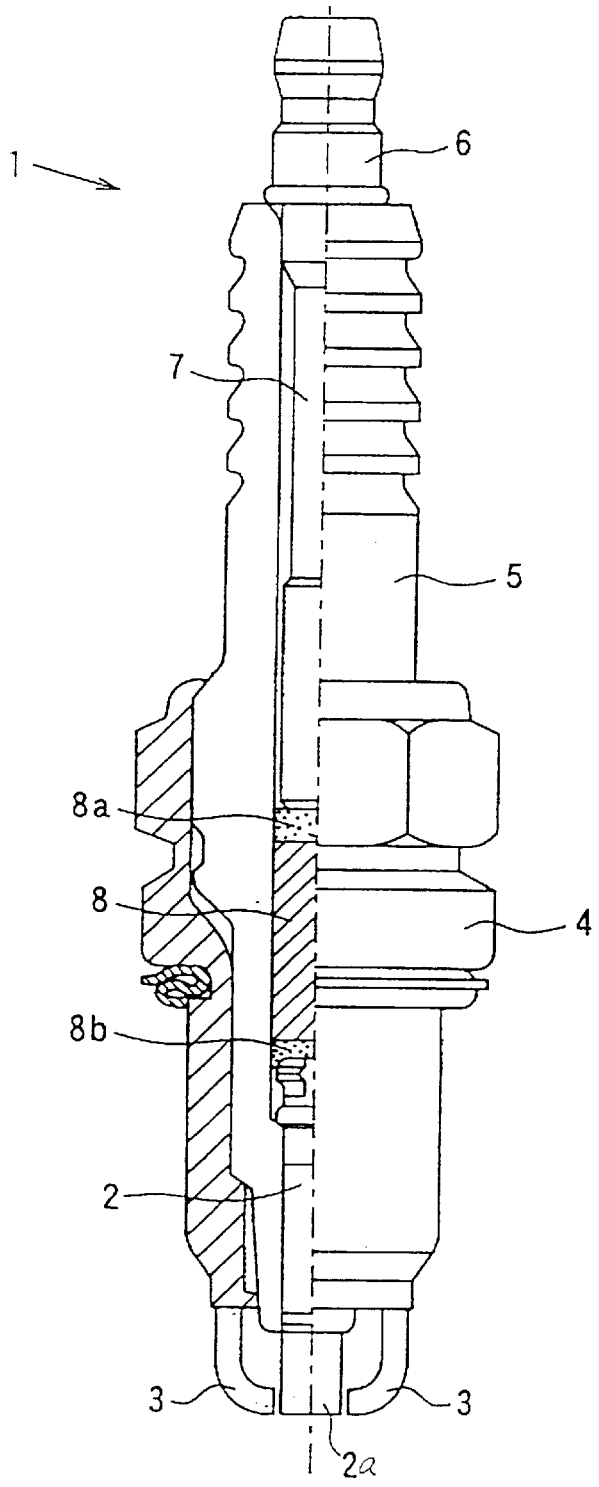
FIG. 1 is a partially sectional view which shows an example of a spark plug which is fabricated in a manner according to the first embodiment of the invention.

A spark plug production method according to this embodiment will be described below taking, as an example, the spark plug 1, as shown in FIG. 1, which is used in automotive internal combustion engines.

The spark plug 1 consists of the center electrode 2, the two ground electrodes 3, the metal shell 4, the porcelain insulator 5, the metal stem 7 on which the terminal 6 is installed, and the resistor 8. The metal shell 4 is made of a hollow cylinder and has cut therein a thread for mounting the spark plug 1 in an engine block (not shown). The porcelain insulator 5 is made of an alumina ceramic ($Al_2O_3$) and retained within the metal shell 4. The resistor 8 has a given electric resistance and is installed between the stem 7 and the center electrode 2 within the porcelain insulator 5.

The center electrode 2 is secured in a central chamber of the porcelain insulator 5 and extends along a longitudinal center line of the spark plug 1. The center electrode 2 is insulated electrically from the metal shell 4. The center electrode 2 has the tip 2*a* projecting from the tip of the porcelain insulator 5. The center electrode 2 consists of a core portion made of a metallic material such as Cu having a higher thermal conductivity and an external portion made of a metallic material such as an Ni-based alloy having higher thermal and corrosion resistances.

Each of the ground electrodes 3 is made of an Ni-based alloy bar whose main component is nickel and welded directly to the end of the metal shell 4. Each of a tip portion of the ground electrodes 3 is bent at 90° to define a gap (usually called spark gap) between itself and the tip 2*a* of the center electrode 2. In the following discussion, straight ground electrodes before bent to fabricate the ground electrodes 3 will be referred to as bar electrodes 3*a* for convenience of explanation.

The resistor 8 is made of a cylinder formed by sintering a mixture of carbon powder and glass powder (main component) in a furnace. The resistor 8 has installed on ends thereof glass seal layers 8*a* and 8*b* for establishing electric insulation between the center electrode 2 to be exposed to a combustion chamber of the engine and the terminal 6 to be installed outside the combustion chamber.

The installation of the metal shell 4 on the porcelain insulator 5 is achieved by plastically deforming or staking a portion of the metal shell 4 after the resistor 8 is disposed in the porcelain insulator 5.

Figure 2:
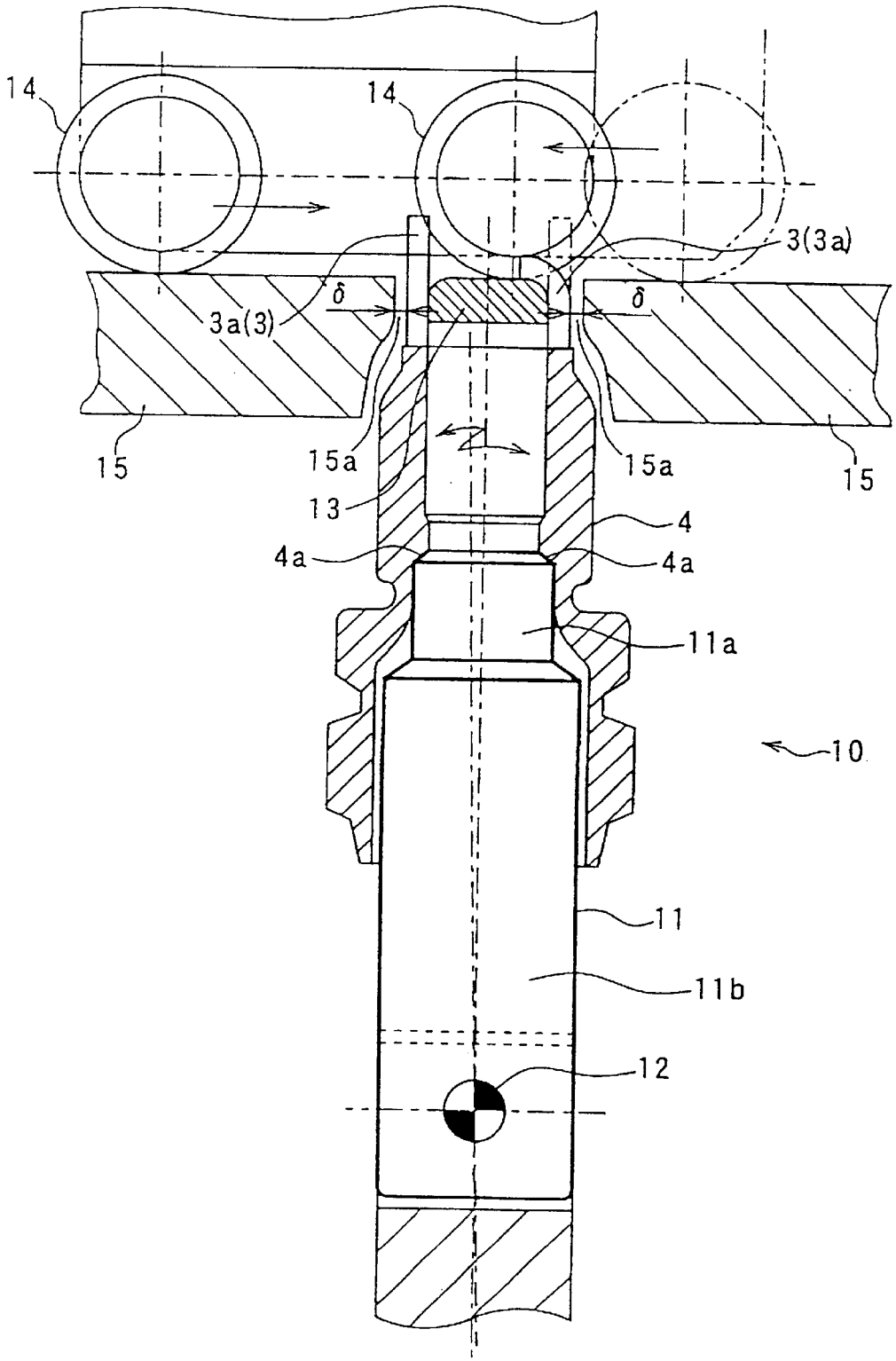
FIG. 2 is a partially sectional view which shows a spark plug fabricating machine designed to bend electrode bars welded to a metal shell of a spark plug to an L-shape.
Figure 3:
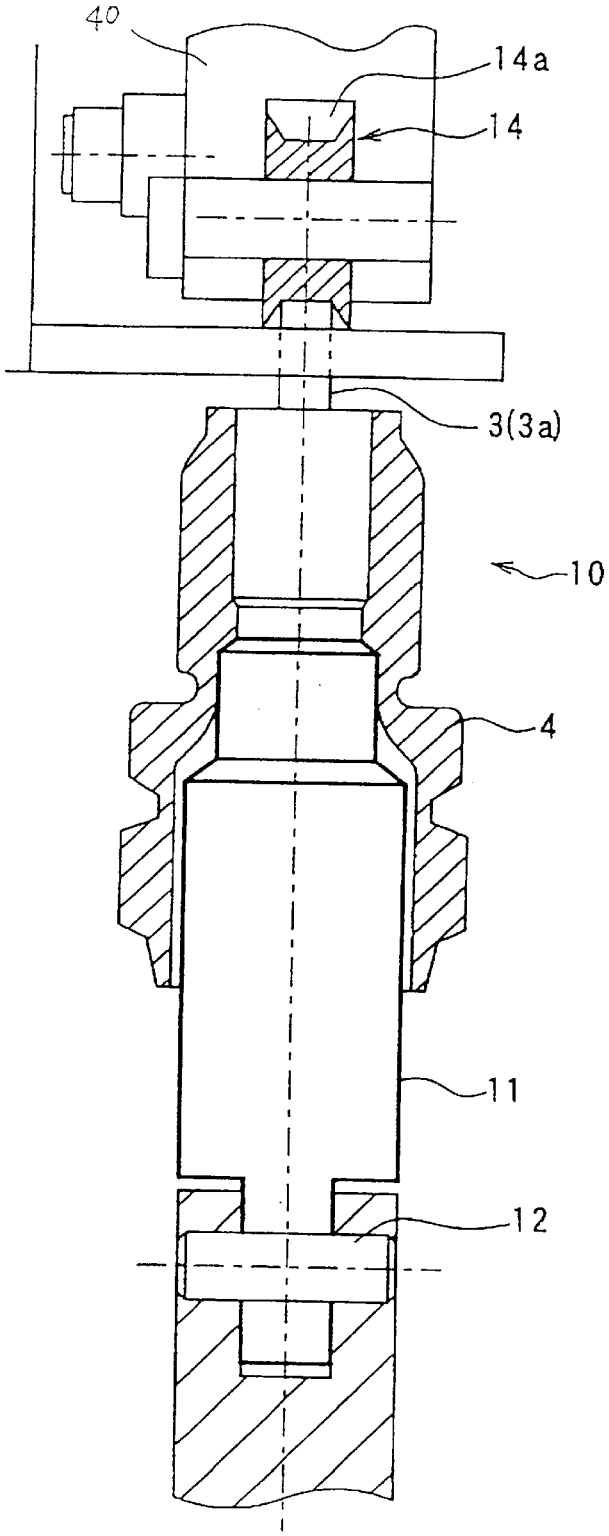
FIG. 3 is a partially sectional side view of FIG. 2.

FIGS. 2 and 3 show a spark plug-fabricating machine 10 by which the spark plug 1 is fabricated in a manner according to the first embodiment of the invention.

The fabricating machine 10 generally includes a shell-holding bar 11, a pair of rollers 14, a die 13, and ground electrode press blocks 15.

The shell-holding bar 11 is formed by a cylinder made up of a small-diameter portion 11*a* and a large-diameter portion 11*b*. The metal shell 4 is put on the shell-holding bar 11 whereby it is held firmly. The metal shell 4 has an annular shoulder 4*a* formed on an inner wall thereof. The small-diameter portion 11*a* of the shell-holding bar 11 has a chamfered surface which engages the shoulder 4*a* of the metal shell 4, thereby holding the metal shell 4. The shell-holding bar 11 has a hole formed in an end of the large-diameter portion 11*b*. A support pin 12 is inserted into the hole of the shell-holding bar 11 to join it to a base of the fabricating machine pivotably. A plane on which the shell-holding bar 11 is swung about the support pin 12 is so oriented as to include the direction in which the rollers 14 move. In other words, a longitudinal center line of the support pin 12 extends perpendicular to the direction of movement of the rollers 14.

The die 13 has outer curves contoured to conform with the contour of inner curves of the ground electrodes 3 and is retained movably in a direction perpendicular to the direction in which the shell-holding bar 11 swings. The die 13 is interposed between the electrode bars 3*a* after the metal shell 4 is secured by the shell-holding bar 11.

The rollers 14 are, as clearly shown in FIG. 3, installed in a guide mechanism 40. The guide mechanism 40 moves the rollers 14 in approach directions toward the die 13 to press the electrode bars 3*a* from the outside thereof against the die 13, thereby bending the electrode bars 3*a* to an L-shape, respectively. Each of the rollers 14, as clearly shown in FIG. 3, has an annular guide groove 14*a* formed in the periphery thereof in which a corresponding one of the electrode bars 3*a* is engaged so that it may be bent in the direction of movement of the roller 14 precisely.

The ground electrode press blocks 15 are disposed, as clearly shown in FIG. 2, outside the electrode bars 3*a* through given gaps 15*a* and work to suppress undesirable deformation or outward bulging of the electrode bars 3*a* when pressed by the rollers 14.

In a spark plug fabricating operation, the electrode bars 3*a* are first welded to the tip of the metal shell 4 at a given interval away from each other. Next, the metal shell 4 is fitted on the shell-holding bar 11 of the fabricating machine 10. Subsequently, the fabricating machine 10 moves the die 13 into a gap between the electrode bars 3*a* and holds it at a given level. The guide mechanism 40 moves one of the rollers 14 (e.g., the right one in FIG. 2) toward a corresponding one of the electrode bars 3*a* (the right one in FIG. 2). The shell-holding bar 11 is, as described above, retained by the support pin 12 to be swingable in the direction of rotational movement of the rollers 14. Thus, even when the roller 14 hits and pushes the electrode bar 3*a*, the electrode bar 3*a* moves without being bent until it hits the side of the die 13 completely. After the electrode bar 3*a* hits the die 13, the guide mechanism 40 further pushes the roller 14 to bend the electrode bar 3*a* along the curve of the die 13, thereby forming a bend of the electrode bar 3*a* contoured to substantially conform with the L-shape of the ground electrodes 3.

When an end portion of the electrode bar 3*a* is subject to a press by the roller 14, it will cause a reactive force to be produced which bulges a central portion of the electrode bar 3*a*. This bulging is, however, suppressed by a neighboring one of the ground electrode press blocks 15. If each of the ground electrode press blocks 15 is too close to a corresponding one of the electrode bars 3*a*, it may cause a great reactive pressure to be exerted from the ground electrode press 15 on the electrode bar 3*a*, which may result in scratches on the surface of the electrode bar 3. In order to avoid this problem, it is advisable that an interval $\delta$ between the end of each of the ground electrode press blocks 15 and the outer wall of the electrode bar 3*a* be set to 0.2 mm to 0.25 mm, and that the ends of the ground electrode press blocks 15 be finished smoothly.

Upon completion of bending of the one of the electrode bars 3*a*, the guide mechanism 40 starts to move the other roller 14 toward the remaining electrode bar 3*a* and pushes it into engagement with the other side of the die 13. After the electrode bar 3*a* hits the other side of the die 13, the guide mechanism 40 further pushes the roller 14 to bend the electrode bar 3*a* inwardly.

Figure 4:
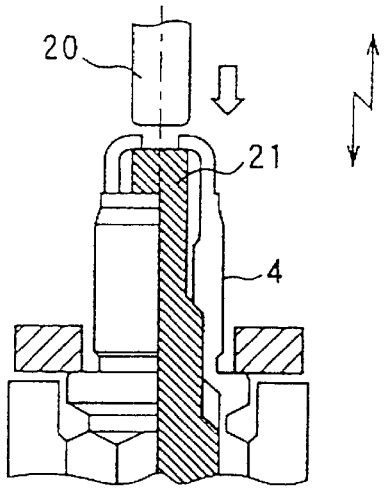
FIG. 4 is a partially sectional view which shows a finishing process of a spark plug fabricating operation.

After the two electrode bars 3*a* are bent along the curves of the die 13, the tips of the electrode bars 3*a*, as shown in FIG. 4, may be struck with a hammer 20 to absorb springback of the electrode bars 3*a* in order to adjust an interval or spark gap between each of the ground electrodes 3 and the center electrode 2 to a desired value. The hammer 20 is so installed in the fabricating machine 10 as to reciprocate vertically through a cam mechanism. A hammer seat 21 is inserted into the metal shell 4 and held at a level where the electrode bars 3*a* are struck with the hammer 20 to have a desired L-shape.

Finally, the tips of the electrode bars 3*a* are cut to a desired shape to make the ground electrodes 3.

As apparent from the above discussion, the fabricating machine 10 of this embodiment first moves each of the rollers 14 until a corresponding one of the electrode bars 3*a* hits the side of the die 13 and then presses the electrode bar 3*a* against the curve of the die 13, thus improving the uniformity of bend angles of the ground electrodes 3.

Figure 5:
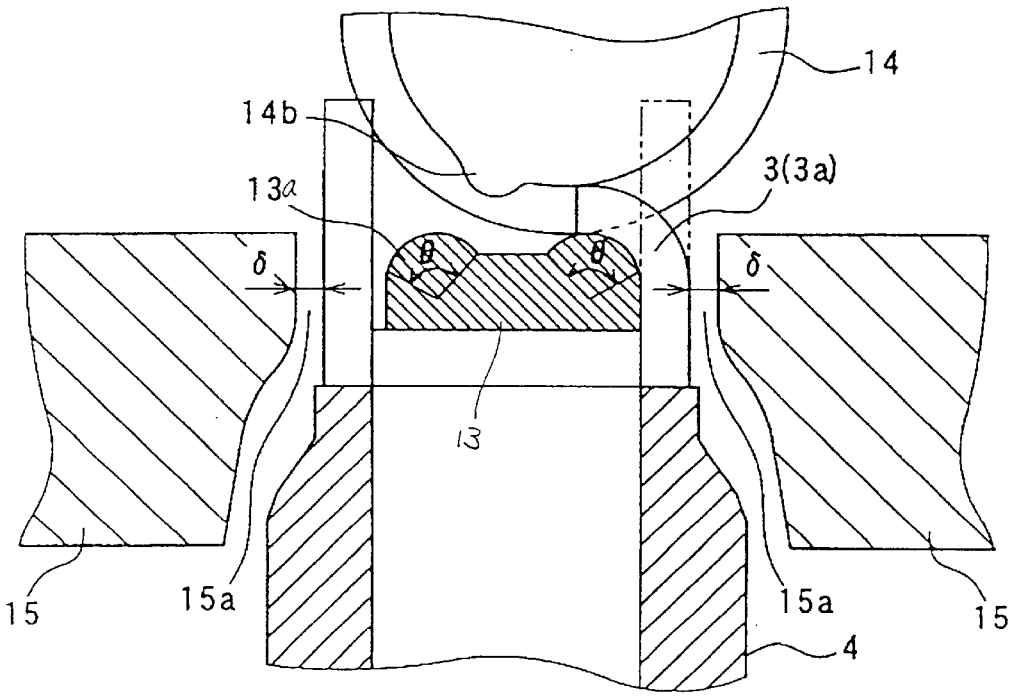
FIG. 5 is an enlarged view which shows a die used in a fabricating operation according to the second embodiment of the invention.

FIG. 5 shows the second embodiment of the invention.

The die 13 has half pipe-like protrusion 13*a* formed on side portions thereof. Each of the half pipe-like protrusions 13*a* has a curve whose cross section is of a dome-shape. The curve has an arc over an angle $\theta$ of more than a desired bend angle of the ground electrodes 3 (e.g., 90°). Each of the rollers 14 has formed on the circumference thereof a protrusion or cam 14*b* which works to bend the tip of the electrode bar 3*a* to an angle more than the desired bend angle of the ground electrodes 3. This compensates for the springback of the electrode bars 3*a* after bent and eliminates the need for the final press process using the hammer 20 in the first embodiment.

Other arrangements are identical with those in the first embodiment, and explanation thereof in detail will be omitted here.

Figure 6:
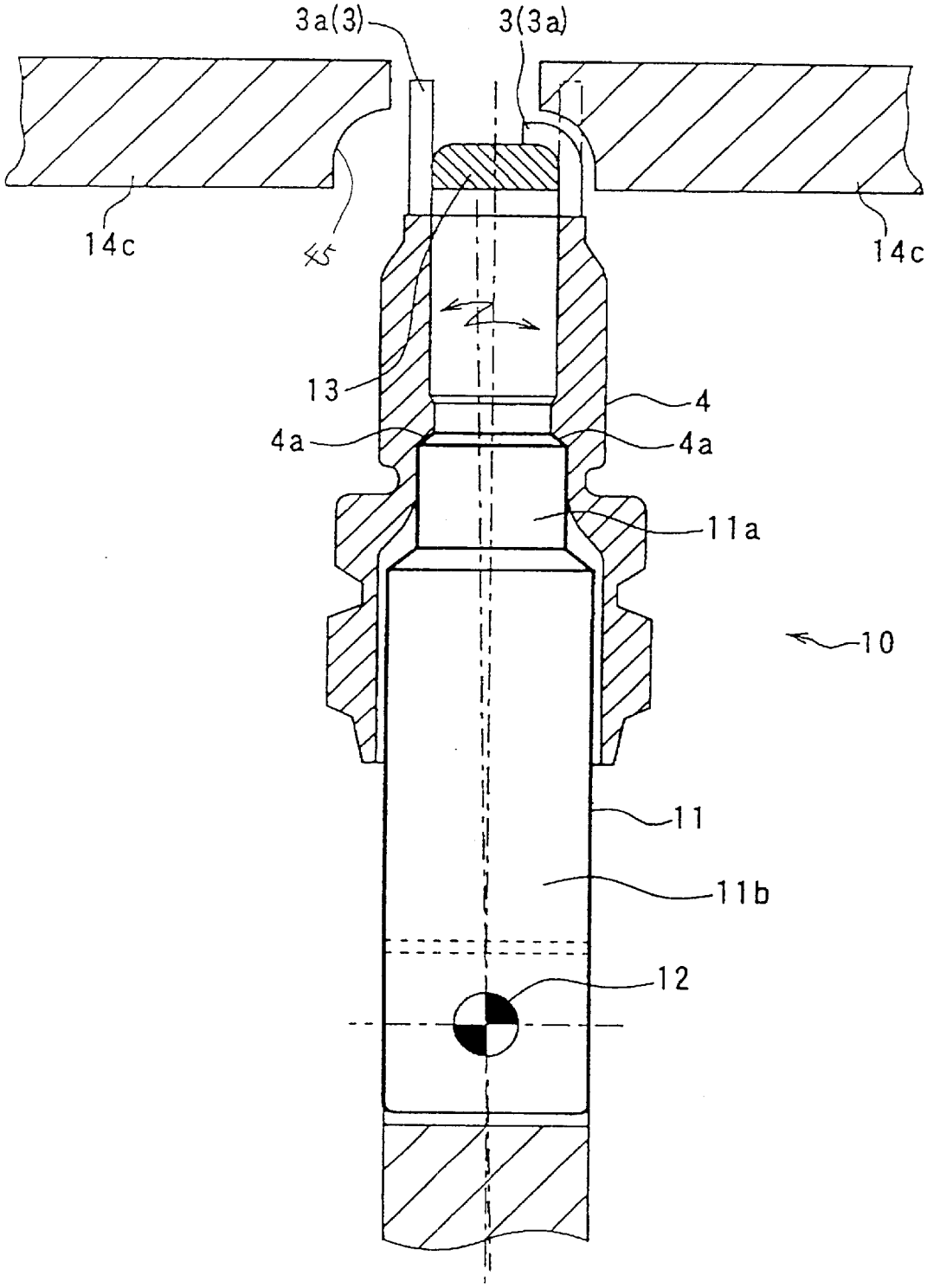
FIG. 6 is a partially sectional view which shows a modification of a fabricating machine.
Figure 7:
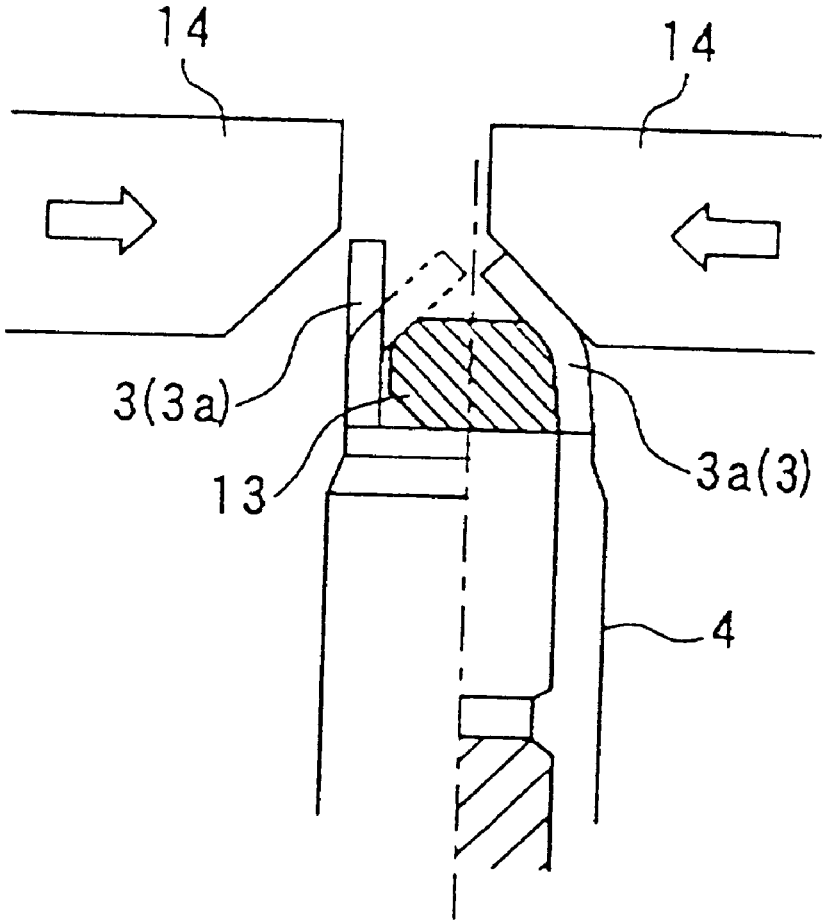
FIG. 7 is a partially sectional view which demonstrates a conventional spark plug fabricating method.
Figure 8A:
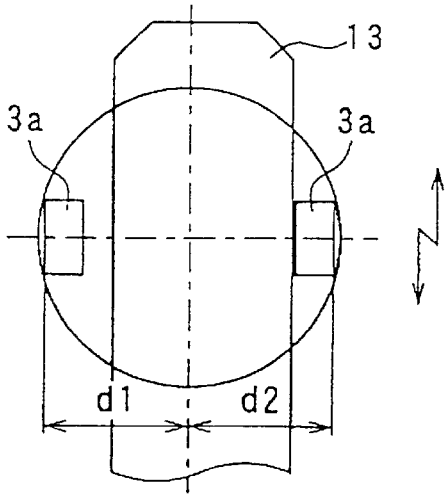
FIG. 8(*a*) is a top view which shows a die interposed between ground electrodes welded on a metal shell before bent.
Figure 8B:
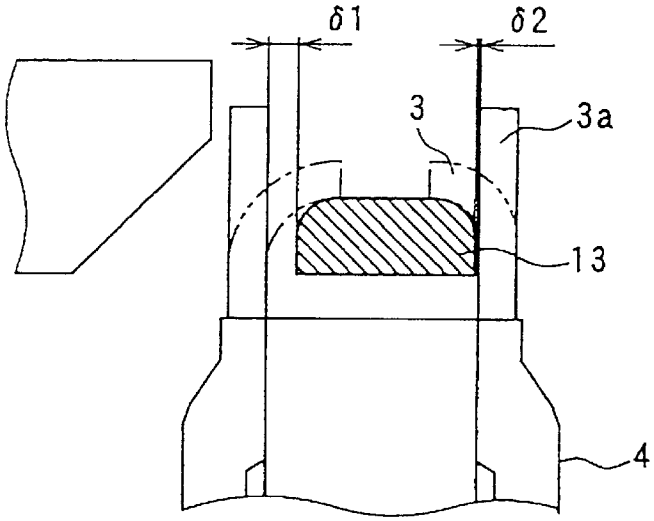
Figure 8C:
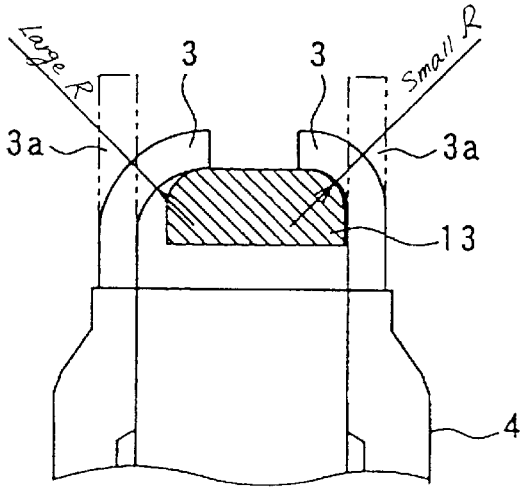

In the above first and second embodiments, the rollers 14 are used as press dies, however, a pair of press dies 14*c*, as shown in FIG. 6, may alternatively be used to bend the electrode bars 3*a* to the L-shape. Each of the press dies 14*c* has formed in an inner corner thereof a half pipe-like groove 45 contoured to conform with the L-shape of the ground electrodes 3. The use of the press dies 14*c* eliminates the need for the ground electrode press blocks 15 as well as the rollers 14.

While the present invention has been disclosed in terms of the preferred embodiments in order to facilitate better understanding thereof, it should be appreciated that the invention can be embodied in various ways without departing from the principle of the invention. Therefore, the invention should be understood to include all possible embodiments and modifications to the shown embodiments which can be embodied without departing from the principle of the invention as set forth in the appended claims. For instance, the fabricating machine 10 may be designed to bend three or more ground electrodes to the L-shape in the same manner as described in the above embodiments.

What is claimed is:

1. A fabricating method of fabricating a spark plug with at least two ground electrodes which are bent to an L-shape to have ends facing through spark gaps a center electrode installed in a housing, the fabricating method comprising the steps of:

welding at least two electrode bars to the housing of the spark plug at a given interval away from each other;

placing a first die at a location where the center electrode is to be installed between the electrode bars, the die having curves each contoured to conform with the L-shape of the ground electrodes;

moving a second die to urge one of the electrode bars into contact of an inner surface thereof with said first die;

pushing said second die to press the one of the electrode bars against a corresponding one of the curves of the first die, thereby bending the one of the electrode bars to fabricate one of the ground electrodes of the L-shape;

moving a third die to urge the other electrode bar into contact of an inner surface thereof with said first die; and pushing said third die to press the other electrode bar against the other curve of the first die, thereby bending the other electrode bar to fabricate the other ground electrode of the L-shape.

2. A fabricating method as set forth in claim 1, further comprising the step of holding the housing so as to allow each of the electrode bars welded on the housing to move relative to a corresponding one of the second and third dies for absorbing a gap between each of the electrode bar and the first die, said holding step also placing the housing so that each of the electrode bars is located at a given interval away from one of deformation avoiding blocks installed outside the electrode bars.

3. A fabricating method as set forth in claim 2, wherein said interval is between 0.2 mm and 0.25 mm.

4. A fabricating method as set forth in claim 1, wherein each of said second and third dies is implemented by a rotary roller having a peripheral surface which urges a corresponding one of the electrode bars into engagement with said first die.

5. A fabricating method as set forth in claim 4, wherein each of the rotary rollers has formed in the peripheral surface thereof a groove in which a corresponding one of the electrode bars is engaged when bent.

6. A fabricating method as set forth in claim 1, further comprising the step of, after each of the electrode bars is bent, adjusting the spark gap between the electrode bar and the center electrode.

7. A fabricating method as set forth in claim 1, wherein each of the pushing steps bends one of the electrode bars to an angle greater than a bend angle of the ground electrodes for compensating for springback.

* * * * *